US011434695B2

(12) United States Patent
Russell

(10) Patent No.: US 11,434,695 B2
(45) Date of Patent: Sep. 6, 2022

(54) PROJECTILE DRILLING SYSTEMS AND METHODS

(71) Applicant: HyperSciences, Inc., Spokane, WA (US)

(72) Inventor: Mark Russell, Spokane, WA (US)

(73) Assignee: HyperSciences, Inc., Spokane, WA (US)

( * ) Notice: Subject to any disclaimer, the term of this patent is extended or adjusted under 35 U.S.C. 154(b) by 0 days.

(21) Appl. No.: 16/059,026

(22) Filed: Aug. 8, 2018

(65) Prior Publication Data

US 2019/0063158 A1 Feb. 28, 2019

Related U.S. Application Data

(60) Provisional application No. 62/542,721, filed on Aug. 8, 2017.

(51) Int. Cl.

| | |
|---|---|
| ***E21B 7/00*** | (2006.01) |
| ***E21B 47/09*** | (2012.01) |
| ***E21B 7/06*** | (2006.01) |
| ***E21B 7/16*** | (2006.01) |

(52) U.S. Cl.

CPC ..... *E21B 7/007* (2013.01); *E21B 7/064* (2013.01); *E21B 7/16* (2013.01); *E21B 47/09* (2013.01)

(58) Field of Classification Search

CPC . E21B 7/007; E21B 7/064; E21B 7/16; E21D 9/106

See application file for complete search history.

(56) References Cited

U.S. PATENT DOCUMENTS

| | | | | |
|---|---|---|---|---|
| 3,516,502 | A * | 6/1970 | Bennett | E21B 7/007 175/4.5 |
| 3,633,686 | A * | 1/1972 | Bennett | E21B 7/007 175/4.5 |
| 4,004,624 | A | 1/1977 | Holstein | |
| 4,004,642 | A * | 1/1977 | Dardick | E21B 4/00 175/4.5 |
| 4,030,557 | A * | 6/1977 | Alvis | E21B 7/007 175/4.5 |
| 4,419,935 | A * | 12/1983 | Shibukawa | F42D 1/10 102/312 |
| 4,582,147 | A * | 4/1986 | Dardick | E21B 7/007 175/1 |
| 5,574,244 | A | 11/1996 | Powell et al. | |
| 5,996,709 | A * | 12/1999 | Norris | E21B 7/16 175/2 |
| 6,000,479 | A * | 12/1999 | Ambs | E21C 37/16 175/4.57 |
| 7,942,481 | B2 * | 5/2011 | Leppanen | E21C 37/12 299/13 |
| 9,458,670 | B2 * | 10/2016 | Russell | F41A 1/02 |
| 9,500,419 | B2 * | 11/2016 | Russell | F41A 1/02 |

(Continued)

OTHER PUBLICATIONS

The PCT Search Report and Written opinion dated Oct. 3, 2018 for PCT Application No. PCT/US18/45886, 8 pages.

(Continued)

*Primary Examiner* — Jennifer H Gay

(74) *Attorney, Agent, or Firm* — Lee & Hayes, P.C.

(57) ABSTRACT

Spherical projectiles may be used to form one or more holes in geologic or other material. These holes may be used for drilling, tunnel boring, excavation, and so forth.

14 Claims, 3 Drawing Sheets

(56) References Cited

U.S. PATENT DOCUMENTS

| | | | | |
|---|---|---|---|---|
| 9,988,844 | B2 * | 6/2018 | Russell | E21B 7/007 |
| 10,329,842 | B2 * | 6/2019 | Russell | E21B 7/007 |
| 10,344,534 | B2 * | 7/2019 | Russell | E21B 7/00 |
| 10,557,308 | B2 * | 2/2020 | Russell | E21B 17/18 |
| 2010/0032206 | A1 * | 2/2010 | Becker | E21B 7/007 175/4.5 |
| 2014/0158356 | A1 | 6/2014 | Andrzejak et al. | |
| 2014/0260930 | A1 * | 9/2014 | Russell | E21B 7/007 89/7 |
| 2015/0247377 | A1 | 9/2015 | Williamson, Jr. | |
| 2015/0330147 | A1 * | 11/2015 | Russell | F41A 1/02 89/7 |
| 2016/0362936 | A1 * | 12/2016 | Russell | F41A 1/02 |
| 2017/0130531 | A1 * | 5/2017 | Russell | F42D 3/04 |
| 2018/0073301 | A1 * | 3/2018 | Russell | E21B 7/16 |
| 2019/0063158 | A1 * | 2/2019 | Russell | E21B 7/064 |
| 2019/0195022 | A1 * | 6/2019 | Russell | F41A 1/02 |

OTHER PUBLICATIONS

Eurasian Office Action dated Nov. 29, 2021 for Eurasian Patent Application No. 202190476, a foreign counterpart to U.S. Appl. No. 16/059,026, 4 pages.

* cited by examiner

PROJECTILE DRILLING SYSTEMS AND METHODS

PRIORITY

This Application claims priority to U.S. Non-Provisional application Ser. No. 16/059,026, filed Aug. 8, 2018, and U.S. Provisional Application No. 62/542,721, filed Aug. 8, 2017, which are incorporated herein by reference.

INCORPORATION BY REFERENCE

The following applications are incorporated by reference for all that they contain:

"Ram Accelerator System" filed on Mar. 15, 2013, application Ser. No. 13/841,236.

"Ram Accelerator System with Endcap" filed on May 13, 2014, App. No. 61/992,830.

"Ram Accelerator System with Rail Tube" filed on Oct. 23, 2014, App. No. 62/067,923.

"Ram Accelerator System with Baffles" filed on Apr. 21, 2015, App. No. 62/150,836.

"Pressurized Ram Accelerator System" filed on Nov. 10, 2015, App. No. 62/253,228.

"Augmented Drilling System Using Ram Accelerator Assembly" filed on Sep. 12, 2016, App. No. 62/393,631.

"Augmented Drilling System Using Ram Accelerator Assembly" filed on Sep. 7, 2017, application Ser. No. 15/698,549.

"Systems for Thermal Generation of Energy" filed on Jan. 17, 2017, App. No. 62/447,350.

"Systems for Thermal Generation of Energy" filed on Jan. 25, 2017, App. No. 62/450,529.

"Projectile Tunneling System" filed on May 8, 2017, App. No. 62/502,863.

BACKGROUND

Traditional drilling and excavation methods utilize drills to form holes in one or more layers of material to be penetrated. Excavation, quarrying, and tunnel boring may also use explosives placed in the holes and detonated in order to break apart at least a portion of the material. The use of explosives results in additional safety and regulatory burdens which increase operational cost. Typically, these methods cycle from drill, blast, removal of material, ground support and are relative slow (many minutes to hours to days per linear foot is typical depending on the cross-sectional area being moved) methods for removing material to form a desired excavation.

BRIEF DESCRIPTION OF THE DRAWINGS

The Detailed Description is set forth with reference to the accompanying figures. In the figures, the left-most digit(s) of a reference number identifies the figure in which the reference number first appears. The same reference numbers in different figures indicate similar or identical items.

DETAILED DESCRIPTION

Figure 1:
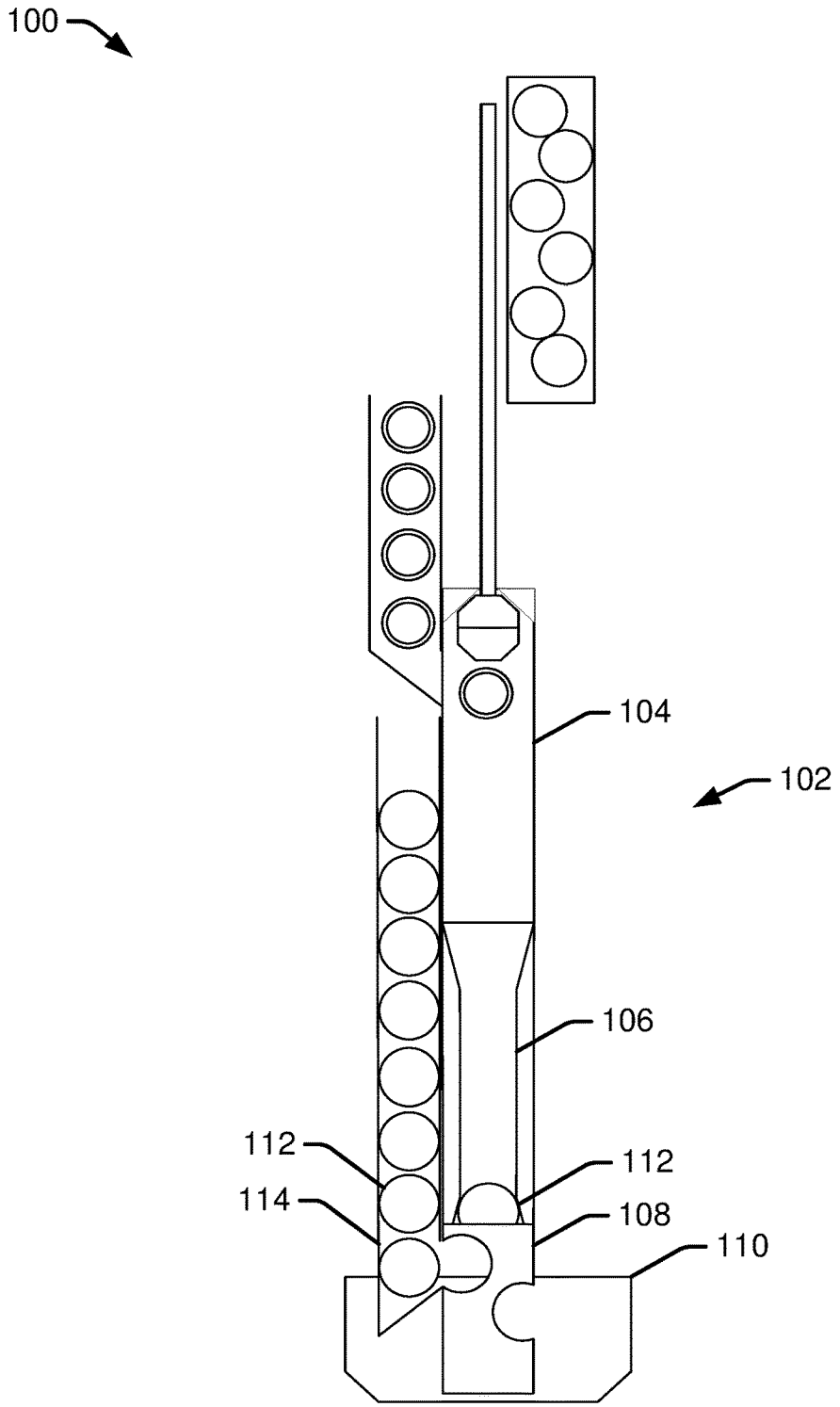
FIG. 1 shows an illustrative embodiment of a projectile launching system.

The projectiles may be generally spherical in shape. Endcaps may be used to seal an end of the tube that is proximate to a working face, such as downhole. Gas generators may be used to produce combustible gasses that are used to propel the projectiles.

A down-hole sorter may be passive or actively actuated. For example, projectiles, endcaps, gas generators, and so forth may be separated from one another via a variety of different techniques including, but not limited to, gravity, centrifugal force, size, vibration, conic and spinning separation, and so forth.

A projectile may jam or become lodged in the device prior to ejection. A crushing and removal mechanism may be used to clear the jammed projectile(s). For example, a hydraulic ram may be used to crush a jammed projectile.

The projectile may have several layers. An inner core may comprise concrete. A middle shell may comprise one or more of polytetrafluoroethylene, perfluoroalkoxy alkane, fluorinated ethylene propylene, or other material. An outer shell may comprise an elastomeric material. For example, the outer shell may comprise rubber that operates as a seal in the tube to hold propellant gasses prior to ignition. In some implementations, either the middle shell or the outer shell may be omitted.

The system may include multiple sections. Each of the sections is configured to hold one or more combustible gases. In one implementation, a projectile is boosted to a ram velocity down the launch tube and through the multiple sections. At the ram velocity, a ram compression effect provided at least in part by a shape of the projectile initiates combustion of the one or more combustible gasses in a ram combustion effect, accelerating the projectile. In some implementations, the projectile may accelerate to a hypervelocity. In some implementations, hypervelocity includes velocities greater than or equal to two kilometers per second upon ejection or exit from the system launch tube.

In other implementations, the projectile may accelerate to a non-hypervelocity. For example, the system may comprise a detonation gun, ventless gun, and so forth. In some implementations, non-hypervelocity includes velocities below two kilometers per second.

The projectiles ejected from the system strike a working face of the geologic material. Projectiles interact with the geologic material at the working face by producing one or more of fractures, a hole, and so forth. By firing a series of projectiles, the material ahead of the system may be fractured, pulverized, vaporized, and so forth.

In some implementations, interactions between projectiles and the geologic materials may be used to steer a drill bit. For example, a launch tube may be oriented at an offset angle relative to the longitudinal axis of a drill bit. Projectiles may be repeatedly accelerated in a selected direction to weaken the geologic materials on one side of the drill bit. Due to the ability of the drill bit to more easily penetrate the weakened portions of the geologic materials, contact with unweakened portions may urge the drill bit toward the direction of the weakened portions. To facilitate penetration of the drill bit in a generally straight direction, the launch tube may be oriented to be generally parallel to and overlapping the longitudinal axis of the drill bit. Successive ejections of projectiles may be timed using various sensors, electronics, and firing mechanisms configured to detect the rotational position of the launch tube. For example, to increase the inclination of a wellbore in a desired direction, the launch tube may be positioned at an offset angle relative to the longitudinal axis of a drill bit. When one or more sensors indicate that the orifice of the launch tube is positioned in the desired direction relative to the longitudinal axis, a projectile may be accelerated through the launch tube and ejected into the geologic material.

FIG. 1 shows an illustrative embodiment of a projectile system 100. For example, projectile system 100 may comprise a ram accelerator system 102 comprising a combustion chamber 104 and a launch tube 106 coupled to a drift tube 108. Additionally or alternatively, portions of the ram accelerator system 102 may be disposed within a drill bit 110.

Additionally or alternatively, various embodiments contemplate that a section separator mechanism is configured provide one or more barriers between the different sections in the system which contain the one or more combustible gasses. For example, launch tube 106 may be sealed off from drift tube 108, by for example an endcap 112. Each section may be configured to contain one or more combustible gasses in various conditions such as particular pressures, and so forth. The section separator mechanism may employ a diaphragm, valve, and so forth which is configured to seal one or more sections. During firing, the projectile passes through the diaphragm, breaking the seal, or the valve is opened prior to launch. A reel mechanism may be used to move an unused section of the diaphragm into place, restoring the seal. Other separator mechanisms such as ball valves, plates, endcaps, gravity gradient, and so forth may also be used. The separator mechanisms may be configured to operate as blow out preventers, anti-kick devices, and so forth. For example, the separator mechanisms may comprise ball valves configured to close when pressure from down the hole exceeds a threshold pressure. Additionally or alternatively, various embodiments contemplate that endcaps 112 may comprise a substantially spherical shape and may be loaded into place through endcap feeder tube and sequencer 114.

The hole formed by the impact of the projectiles may be further guided or processed. A guide tube (also known as a "drift tube" 110) may be inserted into the hole to prevent subsidence, direct a drilling path, deploy instrumentation, and so forth. In one implementation, a reamer or slip-spacer may be coupled to the guide tube and inserted downhole. The reamer may comprise one or more cutting or grinding surfaces configured to shape the hole into a substantially uniform cross section. For example, the reamer may be configured to smooth the sides of the hole.

The reamer may also be configured to apply lateral force between the guide tube and the walls of the hole, canting or otherwise directing the drill in a particular direction. This directionality enables the system to form a curved drilling path.

The guide tube is configured to accept the projectiles ejected from the system and direct them towards the working face. A series of projectiles may be fired from the system down the guide tube, allowing for continuous drilling operations. Other operations may also be provided, such as inserting a continuous concrete liner into the hole.

A cutting head may comprise one or more drill bits that operate against the working face.

Ejecta comprising materials resulting from the impact of the one or more projectiles with the geologic material may be removed from the hole. In some implementations, a back pressure resulting from the impact may force the ejecta from the hole. In some implementations a working fluid such as compressed air, water, and so forth may be injected into the hole to aid in removal of at least a portion of the ejecta. The injection may be done continuously, prior to, during, or after, each launch of the projectile.

One or more systems may also be deployed to drill several holes for tunnel boring, excavation, and so forth. A plurality of accelerators may be fired sequentially or simultaneously to strike one or more target points on a working face. After several holes are formed from projectile impacts, various techniques may be used to remove pieces of geologic material defined by two or more holes which are proximate to one another. Mechanical force may be applied by breaker arms to snap, break, or otherwise free pieces of the geologic material from a main body of the geologic material at the working face. In other implementations, conventional explosives may be placed into the system drilled holes and detonated to shatter the geologic material.

In some implementations, conventional drilling techniques and equipment may be used in conjunction with system drilling. For example, the system may be used to reach a particular target depth. Once at the target depth, a conventional coring drill may be used to retrieve core samples from strata at the target depth.

The systems and techniques described may be used to reduce the time, costs, and environmental necessary for resource extraction, resource exploration, construction, and so forth. Furthermore, the capabilities of system drilling enable deeper exploration and recovery of natural resources. Additionally, the energy released during impact may be used for geotechnical investigation such as reflection seismology, strata characterization, and so forth.

Figures 2A, 2B, 2C:
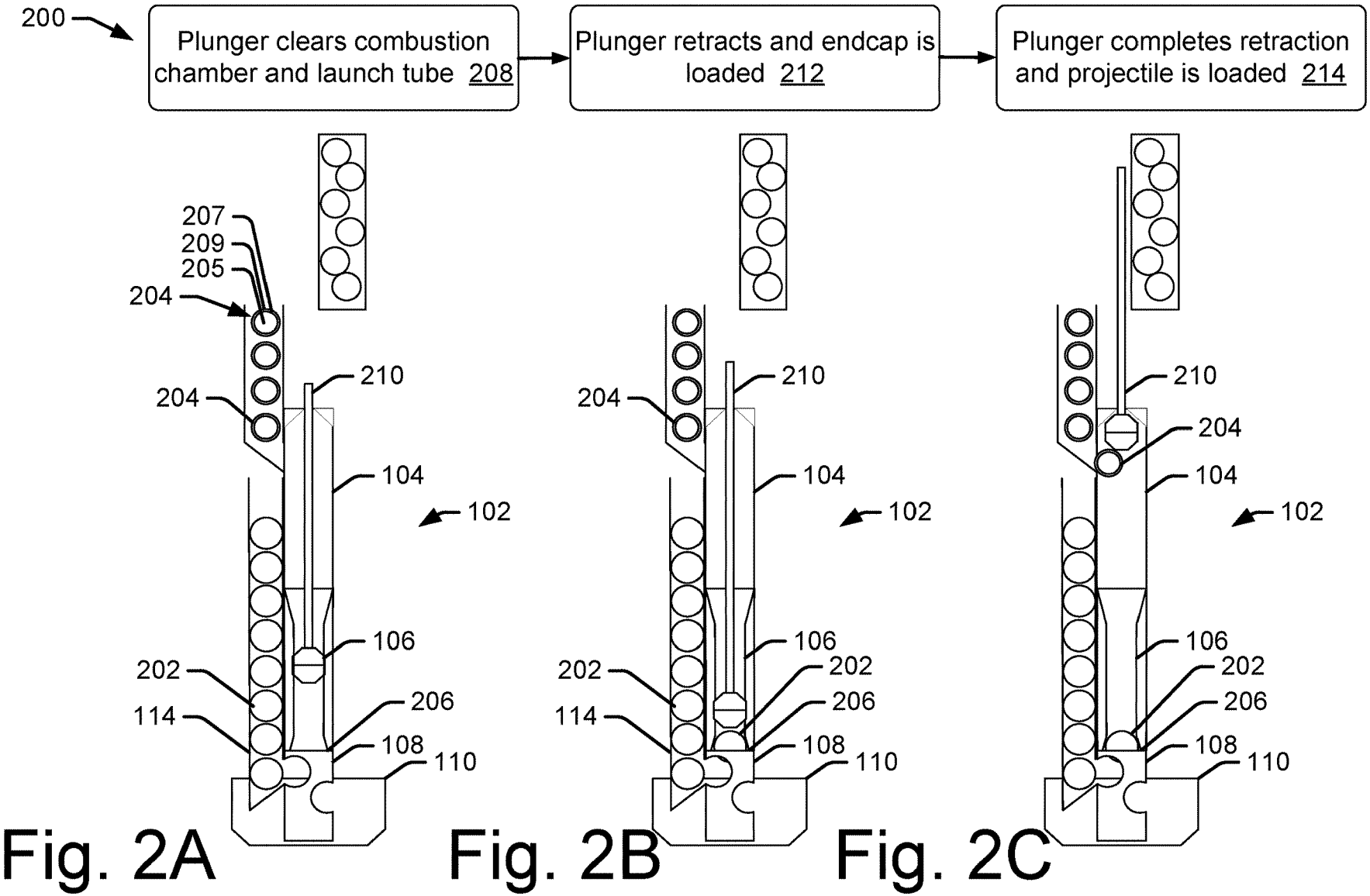
FIGS. 2A-C and 3A-C show illustrative methods and techniques of operation of projectile launching systems.

FIGS. 2A-C depict a method 200 for placing an endcap 202 and projectile 204 within the launch tube 106 of a ram accelerator system 102. As described with regard to FIG. 1, a ram accelerator system 102 may be positioned within a drilling string proximate to the drill bit 110.

The ram accelerator system 102 may include a launch tube 106 having an upstream end that terminates at a combustion chamber 104, and a downstream end terminating at an orifice 206 in the face of the drill bit 110. In use, pressure generated using a propellant within the combustion chamber 104 may accelerate a projectile 204 positioned within the launch tube 106 in a downstream direction toward the drill bit 110, where the projectile 204 may exit the orifice 206 to impact the geological formation in front of the drill bit 110. Subsequent operation of the drill bit 110 may cause the drill bit 110 to penetrate through the portion of the formation that is weakened by the interaction with the projectile 204.

At block 208, a plunger 210 extends into the system to clear the combustion chamber 104 and launch tube 106 as well as orifice 206 of any debris.

At block 212, the plunger 210 may be retracted from the orifice 206 and launch tube 106 while endcap 202 may be loaded. Additionally or alternatively, various embodiments contemplate that the endcap may be seated by suction created by a previous launch, an active loading mechanism, suction from the plunger retracting, or combinations thereof.

At block 214, the plunger 210 is fully retracted and projectile 204 is loaded.

Figures 3A, 3B, 3C:
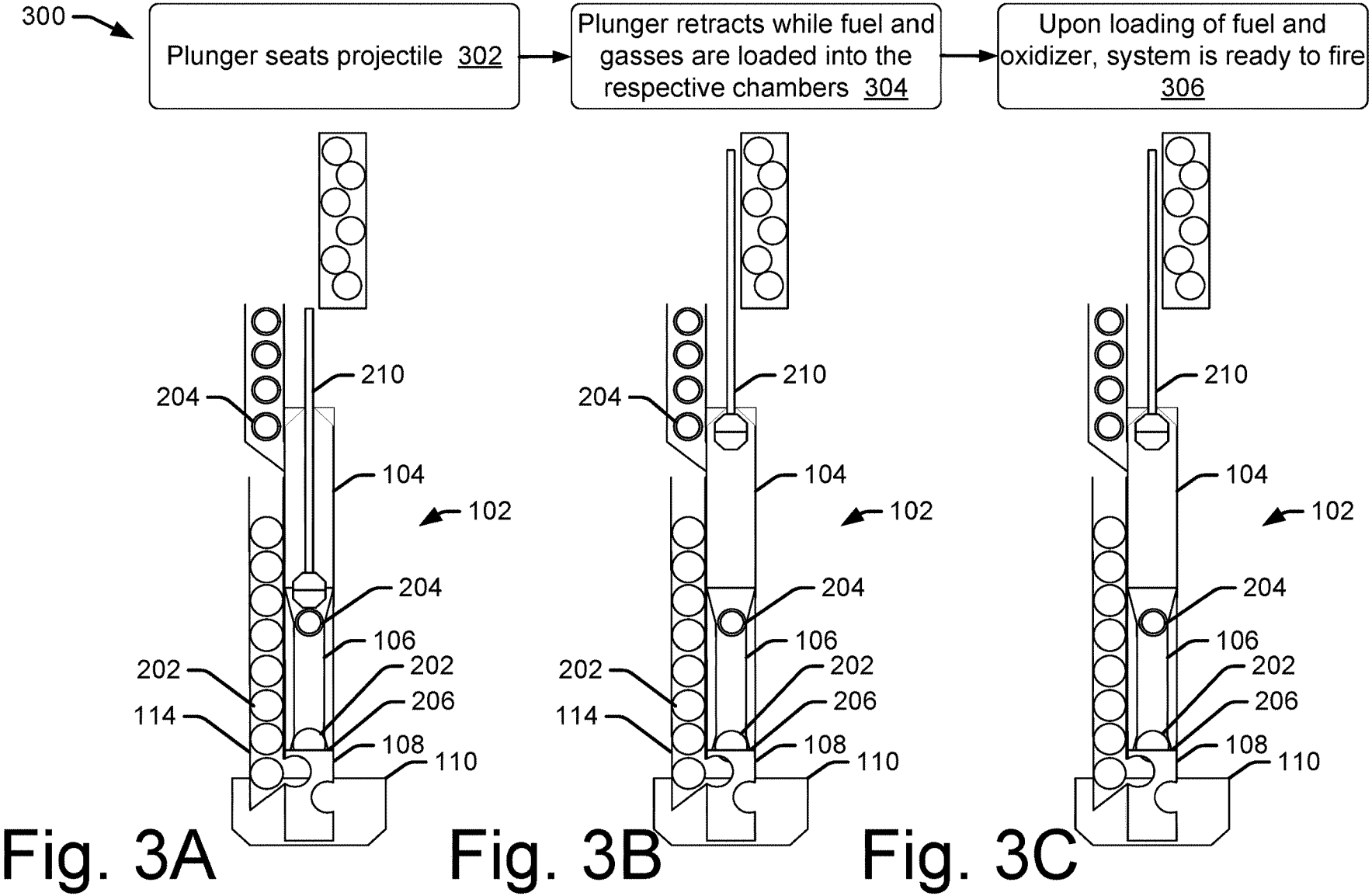

FIG. 3A-C show additional steps 300 in loading a projectile. For example, at block 302 plunger 210 extends and seats projectile 204 into a converging section of the ram acceleration system 102.

At block 304, the plunger 210 retracts. The system may begin adding fuel and combustion gasses into the respective sections and chambers.

At block 306, upon loading of fuel and oxidizers, the system is ready to accelerate the projectile through the ram accelerator system 102.

Additionally or alternatively, various embodiments contemplate that projectile 204 may comprise a rubber coating (that may act as a seal for a detonation gun, and may act as an O-ring equivalent). Additionally alternatively, the projectile may comprise a concrete sphere with Teflon coating to reduce fiction. Additionally or alternatively, various embodiments contemplate that endcap 202 may comprise a Plastic End Cap Ball and may comprise Polyethylene and/or Poly Vinyl Chloride. As noted above, a projectile 204 may have several layers, for example, an inner core 205, a middle shell 207, and an outer shell 209.

Additionally or alternatively, various embodiments contemplate orientating the projectile using a mass/pendulum system. For example, various embodiments contemplate using a sorter to orientate the projectile based at least in part on orientation of one or more of a mechanical dimple, a sealing edge, an optical sorting and orientation system, a magnetic/metallic attraction system, or combinations thereof among others.

Additionally or alternatively, various embodiments contemplate that the launch tube barrel may cycle axially in some implementations. For example, a long barrel movement or a sliding over insert may be used, allowing near contact with the geologic material at the bit, but pulling back away from the working face to facilitate feeding by the endcap feed tube.

The feed tube and launch tube barrel may rotate together and may be off axis from the cutting bit to facilitate end cap feeding.

The endcap may be fed through the bit. For instance, the feed tube may be locked into center of the rotating drill bit and the spherical projectiles are loaded through endcap feed tube into the bit and through bit rotation the launch tube barrel pulls back and grabs or seats the dispensed endcap.

The end of the barrel or gun launch tube may be flared for ease of seating and sealing.

In some implementations, the eyeball hemispherical seal may be more structural efficient. A lip or surface feature may be provided with a sealant.

In some implementations the endcap may be placed after a shot. For example, the pressure differential after firing the projectile may draw the endcap into the tube.

The dynamic sealing endcap deposited from exit side of gun may swage or dynamically hydroform itself into place.

The endcap may be welded into place using an electric current. The weld would be configured to break during or after firing a projectile.

In some implementations, electric welding may be used for the projectile as well.

Additional Illustrative Applications

The system may also be used in industrial applications as well, such as in material production, fabrication, and so forth. In these applications a target may comprise materials such as metal, plastic, wood, ceramic, and so forth. For example, during shipbuilding large plates of high strength steel may need to have holes created for piping, propeller shafts, hatches, and so forth. The system may be configured to fire one or more of the projectiles through one or more pieces of metal, to form the holes. Large openings may be formed by a plurality of smaller holes around a periphery of the desired opening. Conventional cutting methods such as plasma torches, saws, and so forth may then be used to remove remaining material and finalize the opening for use. In addition to openings, the impact of the projectiles may also be used to form other features such as recesses within the target. The use of the system in these industrial applications may thus enable fabrication with materials which are difficult to cut, grind, or otherwise machine.

Those having ordinary skill in the art will readily recognize that certain steps or operations illustrated in the figures above can be eliminated, combined, subdivided, executed in parallel, or taken in an alternate order. Moreover, the methods described above may be implemented as one or more software programs for a computer system and are encoded in a computer-readable storage medium as instructions executable on one or more processors. Separate instances of these programs can be executed on or distributed across separate computer systems.

Although certain steps have been described as being performed by certain devices, processes, or entities, this need not be the case and a variety of alternative implementations will be understood by those having ordinary skill in the art.

Additionally, those having ordinary skill in the art readily recognize that the techniques described above can be utilized in a variety of devices, environments, and situations. Although the present disclosure is written with respect to specific embodiments and implementations, various changes and modifications may be suggested to one skilled in the art and it is intended that the present disclosure encompass such changes and modifications that fall within the scope of the appended claims.

CONCLUSION

Although embodiments have been described in language specific to structural features and/or methodological acts, it is to be understood that the disclosure is not necessarily limited to the specific features or acts described. Rather, the specific features and acts are disclosed herein as illustrative forms of implementing the embodiments. Any portion of one embodiment may be used in combination with any portion of a second embodiment.

What is claimed is:

1. A system comprising:

a drill bit configured to displace material from a geological formation;

a ram accelerator assembly including:

a propellant chamber; and a launch tube extending from the propellant chamber to an orifice in the drill bit;

a spherical projectile within the launch tube, wherein propellant urges the spherical projectile through the launch tube to exit the orifice in the drill bit and impact the geological formation to weaken the geological formation and facilitate displacement of the material from the geological formation by the drill bit; and a plunger in communication with the launch tube, the plunger being movable into the launch tube to position an endcap at a first location and the spherical projectile at a second location and is retractable from the launch tube to evacuate the launch tube.

2. The system of claim 1, the endcap comprising a spherical endcap within the launch tube between the orifice and the spherical projectile, wherein the spherical endcap prevents entry of the material from the geological formation into the launch tube, and wherein the spherical projectile penetrates at least a portion of the spherical endcap when urged through the launch tube to exit the orifice.

3. The system of claim 1, wherein the spherical projectile comprises a core and an outer shell.

4. The system of claim 3, wherein the core comprises a concrete based material.

5. The system of claim 3, wherein the outer shell comprises an elastomer based coating.

6. The system of claim 3, wherein the spherical projectile further comprises a middle shell disposed between the outer shell and the core.

7. The system of claim 6, wherein the middle shell comprises a coating or a polytetrafluoroethylene, perfluoro alkoxy alkane, or fluorinated ethylene propylene based material.

8. A method comprising:

providing a drill bit associated with a ram accelerator assembly having a launch tube that extends between an orifice in the drill bit and a propellant chamber;

extending a plunger into the launch tube to position a spherical endcap at a first end of the launch tube proximate to the drill bit and a spherical projectile at a second end of the launch tube proximate to the propellant chamber;

evacuating the launch tube by retracting the plunger from the launch tube;

using propellant in the propellant chamber to urge the spherical projectile through the launch tube toward the orifice in the drill bit, wherein the spherical projectile penetrates the spherical endcap, exits the orifice in the drill bit, and weakens a portion of a geological formation proximate to the drill bit; and urging the drill bit toward the portion of the geological formation to penetrate the portion of the geological formation with the drill bit.

9. The method of claim 8, further comprising:

positioning the first end of the launch tube relative to a longitudinal axis of the drill bit;

determining, using one or more sensors, that the first end of the launch tube is positioned toward a first side of the drill bit relative to the longitudinal axis;

wherein the spherical projectile is urged through the launch tube to exit the orifice in the drill bit when the first end of the launch tube is positioned toward the first side, and the spherical projectile weakens the portion of the geological formation located in a direction corresponding to the first side of the drill bit; and wherein contact between the drill bit and at least one other portion of the geological formation urges the drill bit toward the portion of the geological formation weakened by the spherical projectile to steer the drill bit in the direction corresponding to the first side.

10. The method of claim 8, wherein the spherical projectile comprises a core and an outer shell.

11. The method of claim 10, wherein the core comprises a concrete based material.

12. The method of claim 10, wherein the outer shell comprises an elastomer based coating.

13. The method of claim 10, wherein the spherical projectile further comprises a middle shell disposed between the outer shell and the core.

14. The method of claim 13, wherein the middle shell comprises a coating or a polytetrafluoroethylene, perfluoro alkoxy alkane, or fluorinated ethylene propylene based material.

* * * * *